United States Patent [19]

Mercer

[11] 3,996,721

[45] Dec. 14, 1976

[54] COMMODITY PACKAGING

[75] Inventor: Frank Brian Mercer, Blackburn, England

[73] Assignee: F.B. Mercer, Limited, England

[22] Filed: Nov. 12, 1974

[21] Appl. No.: 523,065

[30] Foreign Application Priority Data

Nov. 23, 1973 United Kingdom ..... 54527/73
Mar. 13, 1974 United Kingdom ..... 11131/74

[52] U.S. Cl. ..... 53/27; 53/28; 53/182 M; 53/183

[51] Int. Cl.[2] ..... B65B 9/14; B65B 41/18

[58] Field of Search ..... 53/27, 28, 172, 180 R, 53/180 M, 182 R, 182 M, 183, 187

[56] References Cited

UNITED STATES PATENTS

| | | | |
|---|---|---|---|
| 1,353,210 | 9/1920 | Bates | 53/28 X |
| 1,588,649 | 6/1926 | Bates | 53/28 X |
| 2,154,521 | 4/1939 | Maxfield | 53/27 |
| 2,260,064 | 10/1941 | Stokes | 53/27 X |
| 2,761,264 | 9/1956 | Gossett | 53/28 X |
| 3,466,841 | 9/1969 | Rausing | 53/28 |
| 3,492,775 | 2/1970 | Rhine | 53/183 X |
| 3,699,746 | 10/1972 | Titchenal | 53/180 R X |
| 3,726,060 | 4/1973 | McMillan | 53/183 X |
| 3,744,211 | 7/1973 | Titchenal | 53/29 X |
| 3,746,056 | 7/1973 | Titchenal et al. | 53/187 X |
| 3,760,558 | 9/1973 | Kaminsky | 53/183 |

*Primary Examiner*—Travis S. McGehee
*Assistant Examiner*—John Sipos
*Attorney, Agent, or Firm*—Stevens, Davis, Miller & Mosher

[57] ABSTRACT

A method and apparatus for packaging commodities in tubular flexible packaging material in which the packaging material is drawn from a reel over a mandrel structure, the material is continuously axially slit as it passes over the surface of the mandrel, the severed edges of the material are taken in charge and guided around a product opening in the surface of the mandrel, and brought into sealing juxtaposition and sealed together downstream of the mandrel so that the material reverts to a tube with an axial seam. Commodities can be introduced to the tube through the mandrel interior by introducing the commodities to the product opening or the commodities can be introduced to the downstream end of the mandrel with the tubular packaging material being turned inside-out at this point and being caused to travel back through the mandrel interior and out through the product opening. In either case the tube is closed at intervals on discharge from the mandrel to form discrete commodity-containing packages.

26 Claims, 8 Drawing Figures

COMMODITY PACKAGING

This invention relates to a method and apparatus for the making and filling of tubular packages for the packaging of commodities which may be one or more separate articles, discrete materials or liquids.

It is known to pack such commodities as fruit or vegetables in a tube of netting, dividing the tube after filling into individual packages by sealing the tube at each end of the pack as, for example, by metal clips and severing the pack from the tube. This is conventionally carried out by assembling on an inclined feed tube of suitable bore a gathered length of tubular net e.g. extruded plastics net as described in British Patent Specification No. 836,555. At the upper end of the feed tube a hopper provides a reservoir for the commodity to be packed which feeds downwardly through the feed tube by gravity. Adjacent the lower end of the feed tube is a clip sealing machine which applies two closely spaced clip seals to the net tube (which is gathered into a neck at the sealing point) and cuts through the net between the clips. Thus the end of the net tube is closed by a clip and the pocket so formed can be filled with the commodity from the feed tube to the required amount and the net tube rescaled and severed as before.

This method of packaging is quick and efficient and has an acceptable production rate. However there is a limit to the length of net tube that can be loaded onto the feed tube without making the feed tube of cumbersome length, and in consequence packing operations have to be suspended at regular and too frequent intervals to reload the feed tube.

It is an object of the present invention to provide an improved method and apparatus for packaging commodities in a tubular flexible packaging material closed at each end of each pack by a clip or other sealing means and wherein the commodity is fed to the interior of the tube of packaging material by means of a feed tube disposed within the tube of packaging material, in which the feedstock of packaging material is not stored on the feed tube and is only limited as to quantity by its handling weight thus enabling packing operations to proceed for long periods of time without interruption.

The present invention consists in a method of forming commodity packages in which a tubular flexible packaging material is passesd axially along an elongate mandrel including a hollow feed portion with the packaging material enclosing the mandrel, the packaging material is continuously axially slit as it passes over the surface of the mandrel and the severed edges of the packaging material defining the slit are taken in charge by guide means extending along the mandrel to guide the severed edges past a product opening in the surface of the hollow mandrel portion and into sealing juxtaposition downstream of said opening to allow the packaging material to be sealed so that the material reverts to a continuous tube with an axial seal.

The invention further consists in apparatus for commodity packaging comprising an elongate mandrel including a hollow feed portion having a product opening in the surface thereof, drive means for passing a tubular flexible packaging material axially along the mandrel with the packaging material enclosing the mandrel, slitting means for continuously axially slitting the packaging material as it passes over the surface of the mandrel, guide means extending along the mandrel to take the opposing severed edges of the material defining the slit in charge and guide the severed edges past the product opening and into sealing juxtaposition downstream of said opening and sealing means downstream of said opening for sealing the juxtaposed edges so that the packaging material reverts to a continuous tube with an axial seal.

The product opening in the surface of the hollow mandrel portion may be an opening for the introduction of a commodity to be packaged whereby the commodity is passed through the opening created in the packaging material by slitting and through the opening in the hollow mandrel portion so as to deliver the commodity to the interior of the hollow mandrel portion, the sealed tube being closed at intervals after it has passed from a commodity discharge end of the mandrel and received the commodity from the mandrel interior to form the filled tube into commodity containing packages.

Alternatively, after the packaging material has been sealed into an axially seamed tube, the tube may be turned inside out at the downstream end of the mandrel, and be passed back through the interior of the hollow mandrel portion with the commodity to be packaged being introduced to the interior of the sealed tube at the downstream end of the mandrel, and the commodity-filled tube being passed through said opening in the hollow mandrel portion so that the product opening in this case forms a commodity discharge opening. Again on passage through such discharge opening the commodity-filled tube is closed at intervals to form individual commodity-containing packages. This arrangement allows the formation of packages in which the axial seam of the tubular package is on the internal surface thereof. The terms "upstream" and "downstream" refer to the movement of the tubular material over the outer surface of the mandrel whether this movement be spatially upwards, downwards or in any direction.

When using dimensionally unstable packaging materials such as mesh or net structures having diamond-shaped mesh openings (i.e. each opening having a diagonal in the axial direction of the mesh tube) the severed edges of the packaging material defining the slit should be taken in charge by the guide means in the immediate vicinity of the slitting means and preferably before slitting to prevent the slit edges of the material retracting on the mandrel, (i.e. with the material collapsing away from the slit) due to the inherent dimensional instability of such mesh structures. With dimensionally stable packaging materials such as tubular films control of the severed edges is not so critical but nevertheless the severed edges of such materials can be taken in charge by the guide means to equally good effect as can the edges of unstable materials. Preferably therefore the guide means extend back along the mandrel to a position at which the guide means initially engage the packaging material prior to the material being slit.

The guide means may comprise movable elements which engage or clamp the severed edges of the slit packaging material, and the movable elements may be driven to provide also the means for driving the packaging material axially along the mandrel. For example the guide means may comprise endles drive belts which engage the packaging material immediately prior to slitting, guide the severed edges past the product opening in the mandrel and then cause the severed edges to converge towards a sealing juxtaposition at a sealing mechanism.

Packaging materials for use in accordance with the present invention may comprise tubular nets having diamond, rectangular or other shaped mesh openings, tubular films such as polyethylene film or woven or knitted tubular fabrics. It is also within the scope of the invention to produce multi-ply packages in which the individual plies comprise any of the above materials, the apparatus of the invention being suitably modified for the production of such multi-ply packages in a manner yet to be described.

Depending on the packaging material being used and the product being packed, seaming of the severed edges of the material to re-form the material into a tube, may be carried out by sewing, heat sealing, adhesives or stapling. The severed edges can be juxtaposed for sealing in an overlapping manner or can be guided into a vertical flanged butting relationship. Alternatively the edges can be spaced apart and each seamed to an interposed web or tape or like material fed in axially at or before the point of sealing. Such web or tape can conveniently carry printing for labelling purposes and can also be included where the overlapping or vertical butting type of seam is used.

The mandrel can be circular, rectangular, or of any other suitable shape in cross-section and the hollow feed portion can be formed as a tube or as a trough of either continuous wall or openwork construction or both. The hollow feed portion is hereinafter for convenience referred to as the "hollow feed tube" or "feed tube portion." Slitting of the packaging material may be carried out on a portion of the mandrel in the form of a hollow or solid rearward extension of the feed tube portion.

The invention will now be described by way of example with reference to the accompanying drawings in which.

Figure 4:
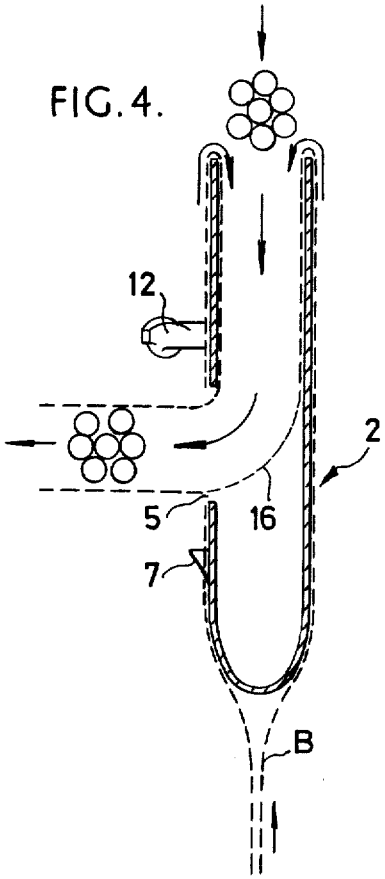
Figure 5:
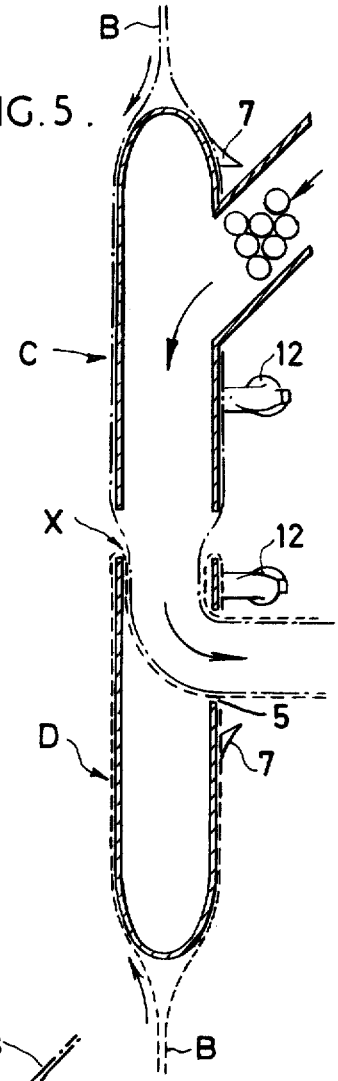
Figure 6:
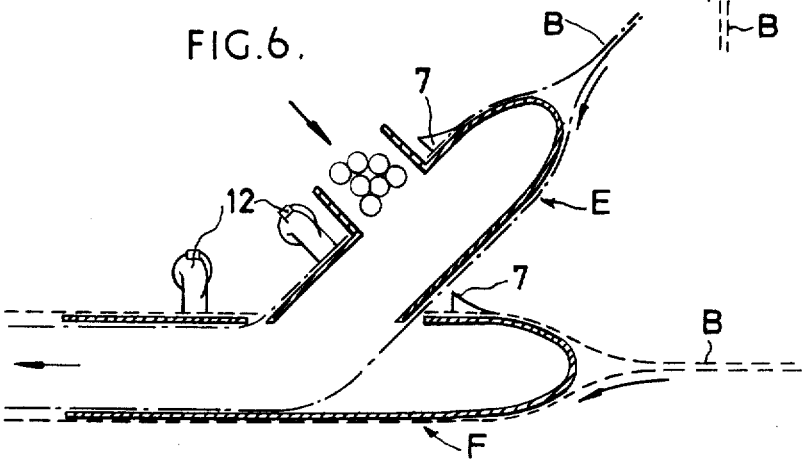
Figure 7:
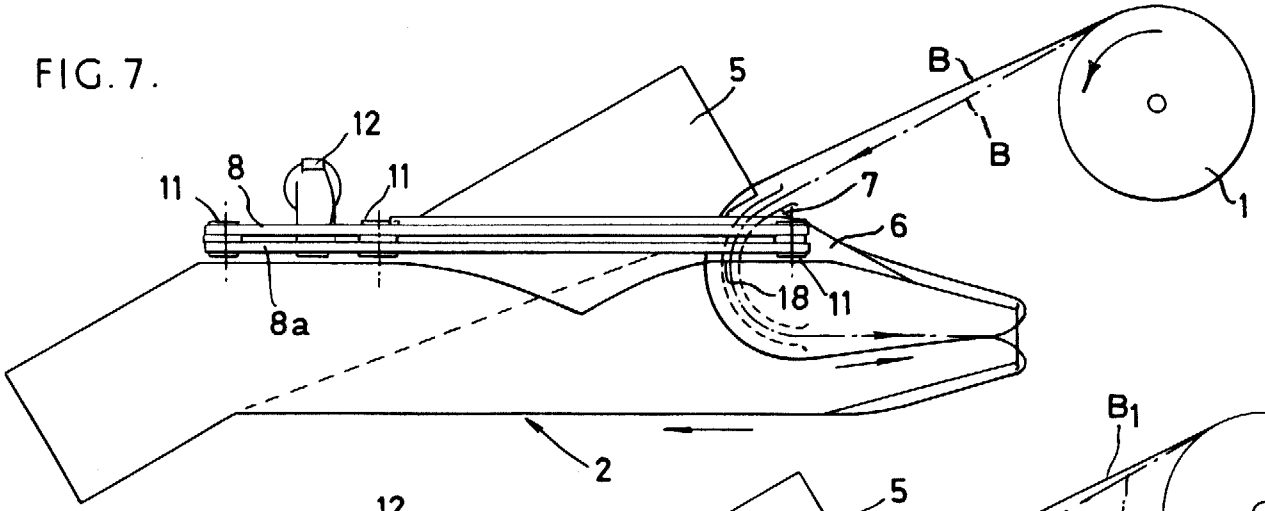
Figure 8:
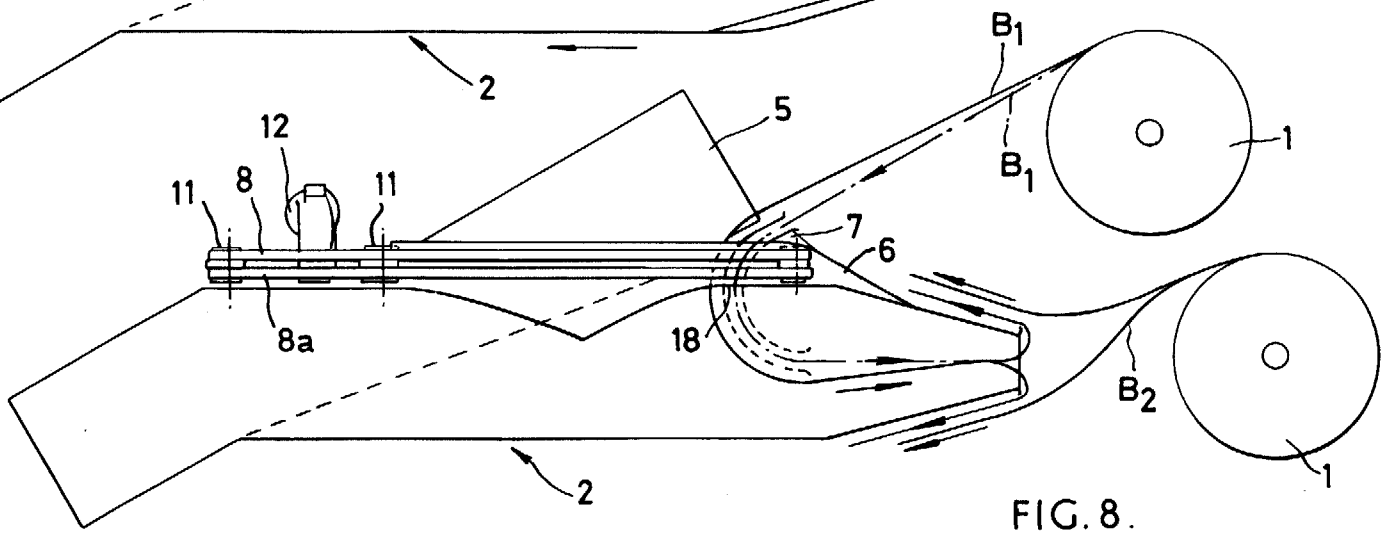

FIG. 4 is a diagrammatic view of a packaging machine embodying the invention used to produce packages having internal seams, FIGS. 5 and 6 are diagrammatic views of packaging arrangements made in accordance with the invention used to produce multi-ply packages, FIG. 7 is a diagrammatic view of a packaging machine made in accordance with the invention showing an alternative method of supplying the packaging material to the machine, and FIG. 8 is a diagrammatic view of the machine shown in FIG. 7 used for producing two-ply packages.

Figure 1:
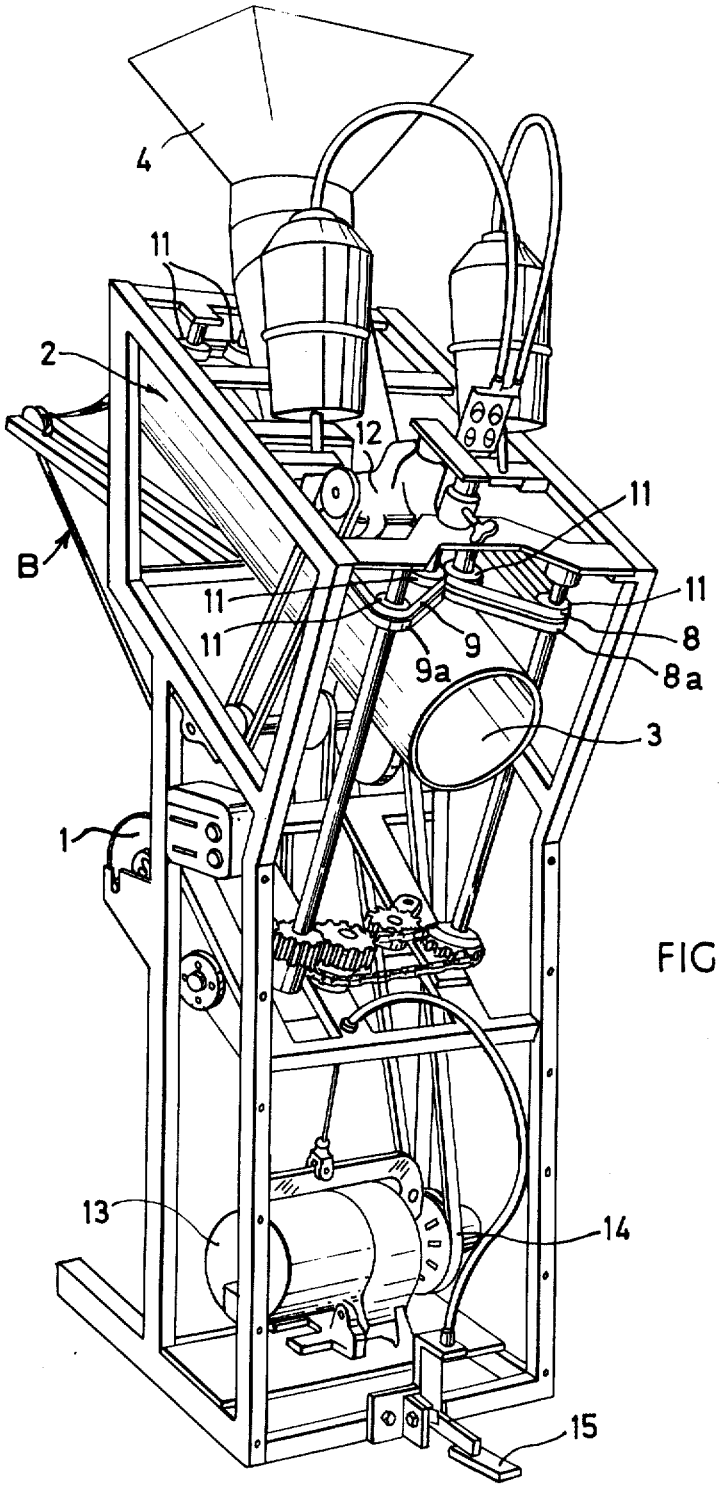
FIG. 1 is a perspective view of a packaging machine embodying the invention.
Figure 2:
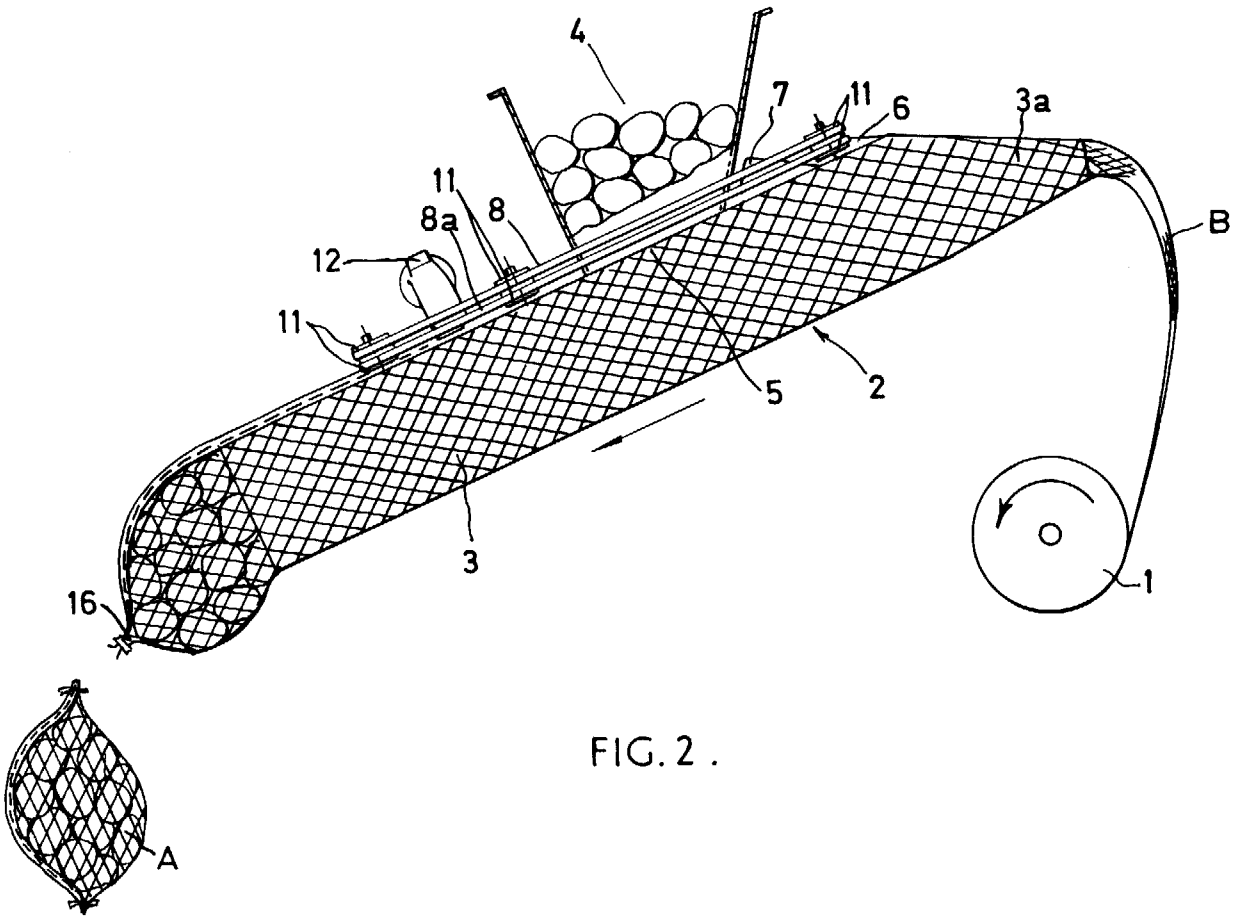
FIG. 2 is a diagrammatic side view showing the basic working components of the machine.
Figure 3:
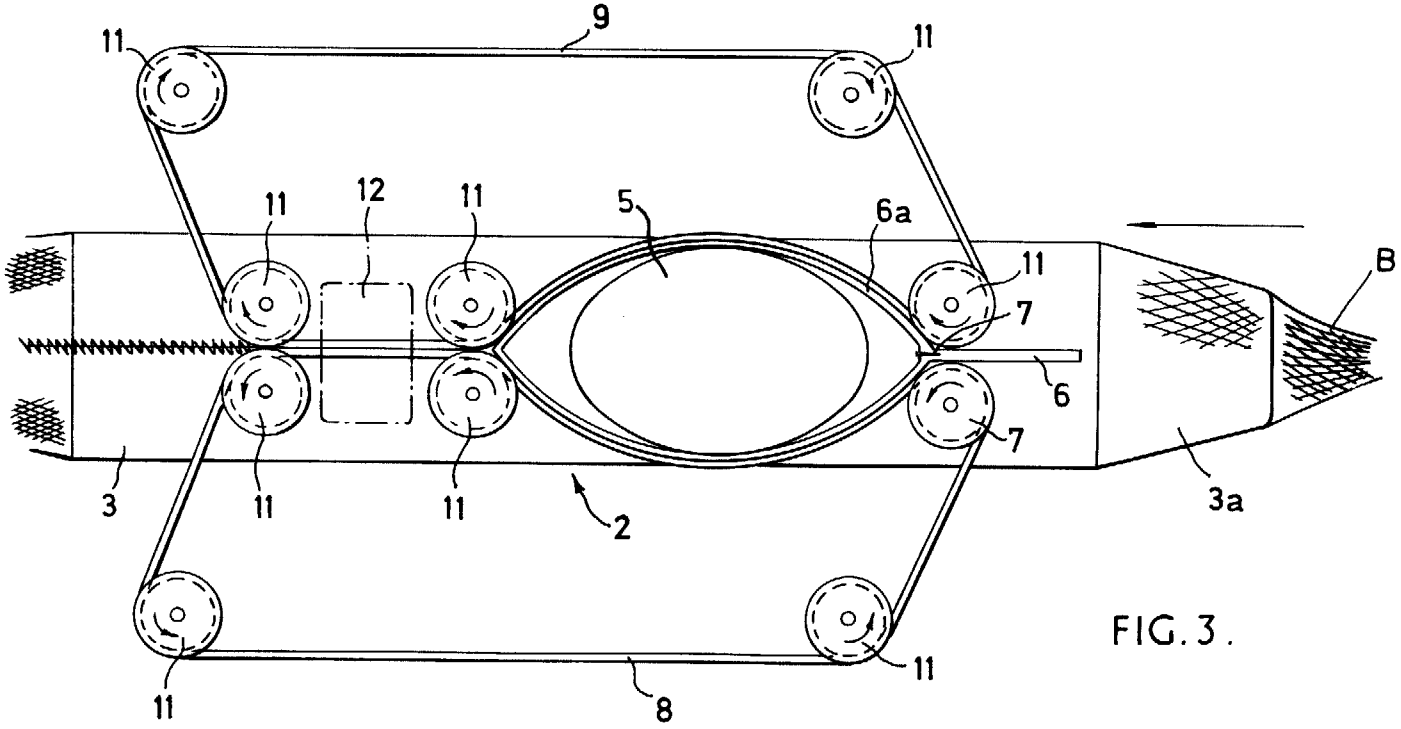
FIG. 3 is a plan view of part of the machine.

Referring firstly to FIGS. 1, 2 and 3, commodity containing packages A (FIG. 2 only) are produced from a tubular packaging net B having diamond shaped mesh openings, for example integrally extruded plastics net as produced according to the invention disclosed in U.K. Patent Specification No. 836,555, the net being stored in rope form on a reel (FIGS. 1 and 2).

The tubular net is drawn from the reel 1 by drive means (to be described) over a downwardly inclined tubular metal mandrel 2 having a hollow feed tube portion 3 and a low friction outer surface (e.g. PTFE), the infeed end 3*a* of the mandrel tapering to a nose and having a bend in its axis to allow the contracted rope net B to be opened out and drawn over and axially along the mandrel in a manner whereby the tubular net encloses the mandrel, the bend in the axis of the mandrel relieving tension in the net as it passes over the mandrel surface.

A commodity feed hopper 4 communicates with the interior of the hollow feed tube portion 3 of the mandrel via a product opening 5 in the surface of the mandrel, and in order to allow the net to pass the hopper, at the upstream end of the hopper the upper mandrel surface is provided with an axially disposed ramp 6 leading to an inclined knife blade 7 which as the net is driven along the mandrel as described hereinafter, continuously axially slits the net so that the severed edges of the net defining the slit can pass along the upper vertical walls of the hopper or as shown in FIG. 3 along the vertical outer surfaces of a former 6*a* fitted around the hopper and forming an extension of the ramp 6.

The severed edges of the net are taken in charge or grabbed and guided around the vertical surfaces of the former 6*a* on each side by pairs of spaced superposed endless driven belts 8, 8*a* and 9, 9*a* having outer (i.e. net contact) surfaces with inherent friction characteristics or having surface formations such as bristles, studs or dimples, the belts being mounted on vertical axis pulleys 11 situated immediately above the upper surface of the mandrel and the drive for the belts being obtained from a motor 13. The active loops of the belts initially engage the net as the net reaches the upper part of the ramp 6 and approaches the knife blade 7 so that when the net is slit the opposing severed edges are trapped in an upturned state between the pairs of moving belts and the vertical ramp surfaces. The active loops of the belts move along the opposed vertical side walls of the former 6*a* trapping and guiding the upturned severed edges of the net against and along the former walls.

On the downstream side of the hopper the walls of the former 6*a* converge and meet at a point on the axis of the mandrel so that the opposed upturned severed edges of the net are drawn along the convergent faces of the former and are thus brought into an abutting juxtaposition as they move off the former and the net edges are then continuously sewn together by a sack sewing machine 12 disposed above the mandrel with a needle positioned to sew on a line between the respective belts of each pair, so that the net again reverts to a continuous tube with an axial seam.

It has been found convenient for the sewing operation to use a sack sewing machine such as a Portable Bag Closure Class 2100 manufactured by Union Special Maschinenfabrik of Stuttgart, Germany. The machine is mounted so that the needle operates on the upturned severed net edges between the pairs of superposed drive belts on each side. Certain modifications are necessary to the standard sewing machine for use in apparatus according to the present invention. The mechanically operated chain cutting device, the lowerfeed dog and upperfeed dog, the pressure foot, operating arms and linkages, bobbin holder, drive motor complete with handle and switch of the conventional sewing machine are all removed and the throat plate is modified so that this will fit nearer to the endless driven net guide belts of the present apparatus. Further, the sewing machine drive is altered from the standard arrangement in which the motor runs at 6,600 RPM and drives the sewing machine through a 5 to 1 reduction gear. In the present arrangement, the motor and drive of the sewing machine are removed so that the sewing machine can be driven from the same drive motor 13 as the endless net guide belts so that the belts and sewing machine can be made to stop and start together and change speed if required through a variable speed drive pulley 14.

It will be appreciated that the endless belts 8, 8*a* and 9, 9*a* also serve as the drive means for drawing the net from the reel 1 and advancing the net along the mandrel. The belts are driven through the pulleys 11 from the common drive motor 13 via suitable drive linkages. A foot pedal control 15 is provided for starting and stopping the drive through a clutch incorporated in the motor unit 13.

The sewing machine may be mounted so as to oscillate in timed relation to the forward speed of the endless guide belts and in synchronism with operation of the sewing machine needle, so that in the case of using film-type packaging material or net material incorporating labelling (to be described hereinafter) the machine can sew without tearing the material. The oscillating mounting of the sewing machine however is not necessary where the packaging material consists solely of mesh or net material. To oscillate the sewing machine use is made of the existing movement for the lower feed dog of the conventional sewing machine, this movement being positively coupled to a frame portion of the present machine and the sewing machine itself being mounted on a pivot so that when the drive is operated the sewing machine itself is caused to oscillate in synchronism with the needle.

Downstream of the sewing machine, the upturned and now seamed severed edges of the net proceed between the nip of the terminal pulleys 11 of the endless guide belts which keep the severed edges of the net in the charge of the belts until after the sewing operation thus maintaining the edges in an upright state through the sewing machine.

On discharge from the mandrel, the seamed tube, with its leading end 16 closed in a previous operation (e.g. clip sealed), receives commodity batches from the feed tube of the mandrel and the drive to the net and sewing machine is then stopped by the operator with the foot-pedal 15. The net tube is then sealed above the commodity in known manner for example by gathering and necking the tube and introducing the necked tube to a conventional clip sealing machine (not shown) which applies a pair of spaced clips to the necked tube and severs the net between the clips to complete the package. The leading end of the tube is thus closed and the operator can re-activate the drive to the belts and sewing machine through pedal 15 to commence production of the succeeding package.

When using packaging materials which are dimensionally unstable such as net with diamond shaped mesh openings as described above, the edges of which would tend to retract on the mandrel when slit, it is necessary to engage the severed edges of the material before such retraction can occur. The precise positioning at which the guide means should engage the material in relation to the slitting knife will vary according to the particular characteristics of the packaging material being used. It is obviously preferred that the guide means should engage the material immediately prior to slitting, but for some materials it may be sufficient for the guide means to engage the severed edges immediately on or after slitting and before the severed edges have had an opportunity to retract.

According to a further feature of the invention it is possible to include labelling in the completed packages by introducing individual labels or continuous strip labelling into the apparatus in a position such that the labels are, or the continuous strip, is sewn into the axial seam in a common sewing operation with the sewing together of the severed edges. For example, the individual labels or strip labelling may be fed into the machine at the upstream end between one set of endless guide belts and the packaging material. In this case it is necessary to ensure that the labels or continuous strip are so formed or of such dimensions that they do not occlude so great an area of the net that the endless belts cannot obtain a sufficient grip on the packaging material to prevent its retraction. To this end separate labels must be adequately spaced and continuous strip label may, for example, be apertured to allow gripping of the net. Alternatively individual labels or strip labelling can be introduced at the downstream end of the machine immediately prior to the sewing operation.

FIG. 4 illustrates diagrammatically how apparatus of the type described above can be used to make internally seamed packages. In this arrangement the tubular packaging material is driven in an upward direction over the mandrel 2 by the endless driven belts (not shown) forming the net guide means and the tube having been slit to pass around the product opening 5 and then resealed as described above, passes into the interior of the mandrel and travels downwardly through the mandrel interior and through the product opening by manual traction, assisted by the gravity feed of the weight of the commodity which is fed through the upper end of the mandrel. A suitable internal support or guide 16 is preferably provided to guide the falling commodity through the product opening which in this case forms a commodity discharge opening. Again, on discharge, the filled tube is sealed into individual packages as described above.

It is possible to produce two-ply packages using a co-operating pair of packaging systems according to the invention. In one form as shown in FIG. 5, an upper packaging arrangement C is of the type as shown in FIGS. 1 to 3 in which the product opening is a commodity infeed opening so that at the discharge end of the mandrel of this upper device an axially seamed first tube is produced, and this tube feeds downwardly into the interior of a lower packaging device D which is of the type shown in FIG. 4 producing a second (internally sealed) tube. Thus, the first (externally seamed) tube from the upper device feeds into the interior of the second (inwardly seamed) tube proceeding down through the interior of the lower mandrel to form a two-ply tube which can be commodity filled through the product opening of the packaging device C. The two-ply tube then discharges through the product opening of the lower packaging device D and is again transversely closed into individual packages. With this arrangement labelling is simplified by the insertion of labels at point X, between the packaging devices C and D, so that the labels are contained between the two plies.

In an alternative form as shown in FIG. 6 a pair of packaging devices E and F are both of the type in which the product opening is a commodity infeed opening. Here, a filled and axially seamed tube from the discharge end of a first device E feeds into the commodity inlet of a second device F so that at the discharge end of the second device the seamed tube from the first device is covered by a second axially seamed tube from the outer surface of the mandrel of the second device. The two-ply tube so formed is filled with the commodity through the inlet of the first device E and is then transversely closed at intervals to again produce two-ply packages in which both plies have separate external axial seams. It will be appreciated that systems according to the invention can be cascaded in this manner to produce packages having more than two plies.

According to a further feature of the invention as shown in FIG. 7, the tubular flexible packaging material can be introduced in rope form to the interior of the hollow mandrel portion either through the product opening 5 or through a further opening 18 which can be upstream (as shown) or downstream of the product opening but within the extent of the slit in the packaging material. The packaging material is fed back along the interior of the mandrel to the upstream end thereof where the packaging material is opened out, turned back upon itself and then fed forwardly along the outer surface of the mandrel for slitting and subsequent seaming as previously described. This alternative method for supplying the tubular flexible packaging material to the outer surface of the mandrel allows for a more compact machine to be manufactured for the production of single-ply packages and also allows the manufacture of two-ply packages with a single mandrel arrangement.

For two-ply packaging, as shown in FIG. 8, a first tubular packaging material $B_1$ is fed to the outer surface of the mandrel from the interior thereof as shown in FIG. 7 and a second tubular packaging material $B_2$ from a reel 1′ is fed to the outer surface of the mandrel over the first material. The separate plies are then slit in common, the respective severed edges are taken in charge and guided around the product opening in common, and then both plies are seamed with a common sealing means to produce a two-ply tube with a single axial seam. One of the plies may be a net product and the other ply a film product or both plies can be either net or film products.

The two-ply packaging method described above with reference to FIG. 8 can be applied to the two-ply packaging method described with reference to FIGS. 5 and 6 to produce either 3- or 4-ply nets by passing an additional ply in the manner described with reference to FIG. 8 through the interior of either the first or second packaging devices C or D or E or F of FIGS. 5 and 6 or through both such devices.

It is thus possible in accordance with the invention to produce multi-ply packages in which at least some of the plies are not interconnected by a common axial seam.

I claim:

1. A method of forming commodity packages comprising continuously conveying a tubular flexible dimensionally unstable packaging net axially, continuously axially slitting the packaging net, grabbing the severed edges of the packaging net defining the slit, positively guiding the severed edges while expanding the distance between the severed edges to define an opening and bringing together said severed edges downstream of said opening, axially sealing said severed edges together so that the net reverts to a continuous tube with an axial seal, transversely sealing said net downstream of said axial sealing to provide a commodity-receiving section, introducing commodity to the interior of said section of said net subsequent to the sealing of the severed edges and severing and sealing said section containing commodity to provide a commodity-containing package.

2. The method of claim 1 including taking in charge portions of the net adapted to define said severed edges prior to the net being slit.

3. The method of claim 1 including holding the severed edges of the packaging net in charge until after the edges have been sealed.

4. The method of claim 1 wherein said sealing of the severed edges of the packaging net is by sewing.

5. The method of claim 1 wherein said commodities are introduced into said net through said opening.

6. The method of claim 1 including turning the axially sealed net inside-out downstream of said axial sealing, passing said net back through the interior of the hollow net and out through said opening, said commodities being introduced into said net at the point of turning said net inside-out.

7. The method of claim 1 wherein the packaging material is a dimensionally unstable material.

8. The method of claim 1 including the step of incorporating labelling with the sealed tube in a common sealing operation with the sealing of the severed edges.

9. The method of claim 8 wherein the labelling comprises individual labels incorporated at intervals along the axial seal.

10. The method of claim 1 including the step of incorporating continuous strip labelling with the sealed tube in a common sealing operation with the sealing of the severed edges.

11. A commodity packaging apparatus comprising an elongate mandrel including a hollow feed portion, a product opening in the surface of said hollow feed portion, drive means for passing a tubular flexible packaging net axially along the mandrel with the packaging net enclosing the mandrel, slitting means for continuously axially slitting the packaging net as it passes over the mandrel, guide means movable lengthwise along the mandrel to take the severed edges of the net defining the slit in charge and guide the severed edges past the product opening and into sealing juxtaposition downstream of said opening, sealing means downstream of said opening for sealing the juxtaposed edges so that the packaging net reverts to a continuous tube with an axial seal, means to transversely seal said axially sealed tube before and after the introduction of commodity into said tube and means to introduce commodity into said axially and transversely sealed tube.

12. The apparatus of claim 11 wherein the guide means is adapted to engage the packaging material at a position prior to the material being slit.

13. The apparatus of claim 11 wherein the guide means is adapted to remain in engagement with the severed edges of the material until after the edges have been sealed by the sealing means.

14. The apparatus of claim 11 wherein the guide means comprises for each severed edge at least one endless drive belt.

15. The apparatus of claim 14 wherein the drive belts also constitute the drive means for advancing the packaging net along the mandrel.

16. The apparatus of claim 15 wherein the drive belts are adapted to trap the respective severed edges in an upturned state against stationary surfaces associated with the mandrel.

17. The apparatus of claim 16 wherein the guide means comprises for each severed edge a pair of spaced superposed drive belts.

18. The apparatus of claim 11 wherein the sealing means is a sewing machine.

19. The apparatus of claim 18 including means for oscillating the sewing machine in timed relation to the forward speed of the packaging material along the mandrel and in synchronism with the operation of the sewing machine needle.

20. The apparatus of claim 11 wherein the mandrel has an upstream end portion tapering to a nose to facilitate the feeding of tubular packaging material onto the mandrel.

21. The apparatus of claim 20 wherein the upstream nose end portion of the mandrel has an axis inclined with respect to the axis of a main body portion of the mandrel.

22. A method of forming commodity packages comprising continuously conveying a first tubular flexible packaging net axially, continuously axially slitting the packaging net, taking in charge the severed edges of the packaging net defining the slit, expanding the distance between the severed edges to define an opening, bringing together said severed edges downstream of said opening, axially sealing said severed edges together so that the net reverts to a continuous tube with an axial seal, continuously conveying a second tubular flexible packaging net axially, slitting said second packaging net, taking in charge the severed edges of said second packaging net defining the slit, expanding the distance between the severed edges to define an opening, bringing together said severed edges downstream of said opening, axially sealing said severed edges together so that the second net reverts to a continuous tube with an axial seal, turning the axially sealed second net inside-out downstream of said axial sealing, passing said second net back through the interior of the hollow second net and out through said opening of said second net, introducing said first net with an axial seal into said second net at the point of turning said second net inside-out and passing it out through the opening of said second net introducing commodities to the two-ply net so formed through the opening of said first net, transversely sealing said commodity charged two-ply net downstream of the opening of said second net to provide a commodity-containing section and severing said commodity-containing section to provide a commodity-containing two-ply package.

23. A method of forming commodity packages comprising continuously conveying a first tubular flexible packaging net axially, continuously axially slitting the packaging net, taking in charge the severed edges of the packaging net defining the slit, expanding the distance between the severed edges to define an opening, bringing together said severed edges downstream of said opening, axially sealing said severed edges together so that the net reverts to a continuous tube with an axial seal, introducing a second tubular flexible packaging net formed in the same manner as the first into the opening of the first net thereby forming a two-ply net, introducing commodities to the interior of the two-ply net through the opening of said second net, transversely sealing said commodity-charged two-ply net downstream of said axial sealing of said first net to provide a commodity-containing section and severing said commodity-containing section to provide a commodity-containing package.

24. A commodity packaging system comprising a first elongate mandrel including a hollow feed portion, a product opening in the surface of said hollow feed portion, a first drive means for passing a first tubular flexible packaging net axially along the first mandrel with the packaging net enclosing said first mandrel, a first slitting means for continuously axially slitting the first packaging net as it passes over said first mandrel, a first guide means movable lengthwise along said first mandrel to take the severed edges of the net defining the slit in charge and guide the severed edges past the product opening and into sealing juxtaposition downstream of said opening and a first sealing means downstream of said opening for sealing the juxtaposed edges so that the packaging net reverts to a first continuous tube with an axial seal, a second elongate mandrel including a hollow feed portion, a product opening in the surface of said feed portion of said second mandrel, a second drive means for passing a second tubular flexible packaging net axially along the second mandrel with the second packaging net enclosing said second mandrel, a second slitting means for axially slitting the second packaging net as it passes over said second mandrel, a second guide means movable lengthwise along said second mandrel to take the severed edges of the second net defining the slit in charge and guide the severed edges past the product opening and into sealing juxtaposition downstream of said opening in said second mandrel, a second sealing means downstream of said opening in said second mandrel for sealing the juxtaposed edges so that the second packaging net reverts to a second continuous tube with an axial seal, said second continuous tube being introduced into the interior of the fist continuous tube to form a multi-ply tube, means to transversely seal said axially sealed multi-ply tube before and after the introduction of commodity into said multi-ply tube and means to introduce commodity into said axially and transversely sealed multi-ply tube.

25. The system as claimed in claim 24 wherein the second mandrel is positioned at the downstream end of the first mandrel to supply said second axially sealed packaging tube to the interior of the first mandrel, said first and second packaging tubes passing out of the opening in said first mandrel.

26. The system as claimed in claim 24 wherein the second mandrel is positioned at the opening of the first mandrel so that a downstream end of the second mandrel can supply the second axially sealed packaging tube to the interior of the first mandrel through the product opening of the first mandrel.

* * * * *